US006381976B1

(12) United States Patent
Kempiak et al.

(10) Patent No.: US 6,381,976 B1
(45) Date of Patent: May 7, 2002

(54) WEDGE SHAPED REFRIGERATED DISPLAY CASE

(75) Inventors: Michael J. Kempiak, Occola, IN (US); Wayne I. Flaska, Niles, MI (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/844,939

(22) Filed: Apr. 27, 2001

(51) Int. Cl.[7] ..... A47F 3/04
(52) U.S. Cl. ..... 62/255; 454/193; 454/309
(58) Field of Search ..... 62/255, 256; 454/193, 454/277, 309

(56) References Cited

U.S. PATENT DOCUMENTS 2,630,054 A * 3/1953 Peterson ..... 454/309
2,655,857 A * 10/1953 Broberg ..... 454/309
3,502,016 A * 3/1970 Steele ..... 454/277
3,743,180 A * 7/1973 Perkins et al. ..... 236/1 C
3,847,066 A * 11/1974 Van Der Ham ..... 236/49.5
4,976,115 A * 12/1990 Hogan ..... 454/309
5,163,871 A * 11/1992 Huibregtse et al. ..... 454/289
5,176,570 A * 1/1993 Liedl ..... 454/309
5,716,270 A * 2/1998 Chambers ..... 454/309
5,755,108 A * 5/1998 Ibrahim et al. ..... 62/256

* cited by examiner

*Primary Examiner*—William E. Tapolcai
(74) *Attorney, Agent, or Firm*—Carlson, Gaskey & Olds, P.C.

(57) ABSTRACT

A refrigerated display case having a substantially wedge shape for displaying items at temperature below the surrounding ambient temperature. The display case includes a cold air discharge having a length and a warm air return having a length substantially greater than the cold air discharge. The cold air discharge includes a diffuser having a plurality of flow directing structures disposed at an angle relative to the direction of airflow to direct the flow air over the entire display case such cold air flows over the entire area of the display case to uniformly cool the entire product display area.

14 Claims, 2 Drawing Sheets

WEDGE SHAPED REFRIGERATED DISPLAY CASE

BACKGROUND OF THE INVENTION

This invention relates to a refrigerated display case for displaying products that require temperatures below a surrounding ambient temperature.

Typically, a refrigerated display case includes a cold air discharge at one end of the case that blows cold air over a display area and products contained therein. Cold air discharged from the cold air discharge flows through a diffuser across the product display area and into a warm air return at the opposite end of the case, to flow back through a cooling circuit and in turn back out the cold air discharge. Typically, the display case is of standard rectangular shape and the cold air discharge and the warm air return at the opposite end are of substantially equal length. The diffuser includes a plurality of straws that are disposed to direct the flow of air perpendicular to the cold air discharge. Typically, the cold air discharge is positioned above the warm air return such that the diffuser is angled downward to direct the flow of air through the product display area to the warm air return.

Some display cases are shaped to provide a pleasing appearance and to separate different product types by being positioned around corners. Historically, an outside corner display case was not refrigerated and used only to provide the appearance of a continuous refrigerated display case. Because the outside corner display case was not refrigerated, only products not requiring refrigeration have been displayed in the outside corner unit.

Recently consumers are requiring refrigerated outside corner units, which presents a design challenge. The geometry of an outside corner display case limits the length of the cold air discharge such that the cold air discharge is typically substantially shorter in length then the warm air return. That is a corner unit has an inner end that tends to be smaller then its outer end. The cold air discharge associated with the smaller end thus directs flow only over a limited portion of the case. This creates uneven cooling of the products displayed. The diffuser used in this prior art display case tended to direct the flow of cold air straight through the center of the display area, leaving the extreme outer edges of the display area inadequately cooled.

For these reasons it is desirable to develop an outside corner refrigerated display case that cools the entire product display area uniformly.

SUMMARY OF THE INVENTION

An embodiment of this invention is a wedge shaped refrigerated display case including an improved diffuser having straws angled relative to the flow of air from the cold air discharge to direct air flow toward the sides of a display area thereby providing uniform cooling of the entire product display area.

The refrigerated display case of this invention is wedge shaped to form an outside corner display case. Cold air from a cold air discharge flows through a diffuser that directs air toward the sides of the display case, through the product display area and to the warm air return. The diffuser disposed at the cold air discharge includes a plurality of straws angled to direct the airflow toward the sides of the display case. The diffuser is also angled downwardly relative to the flow of air such that air is directed downward toward the warm air return. The diffuser preferably includes multiple panels with each panel including a plurality of straws for directing the flow air over the entire display area. The straws direct the flow of air toward the sides of the display case so that all areas in the display area are cooled uniformly.

The subject invention provides a refrigerated display case for an outside corner that cools the entire product display area uniformly.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
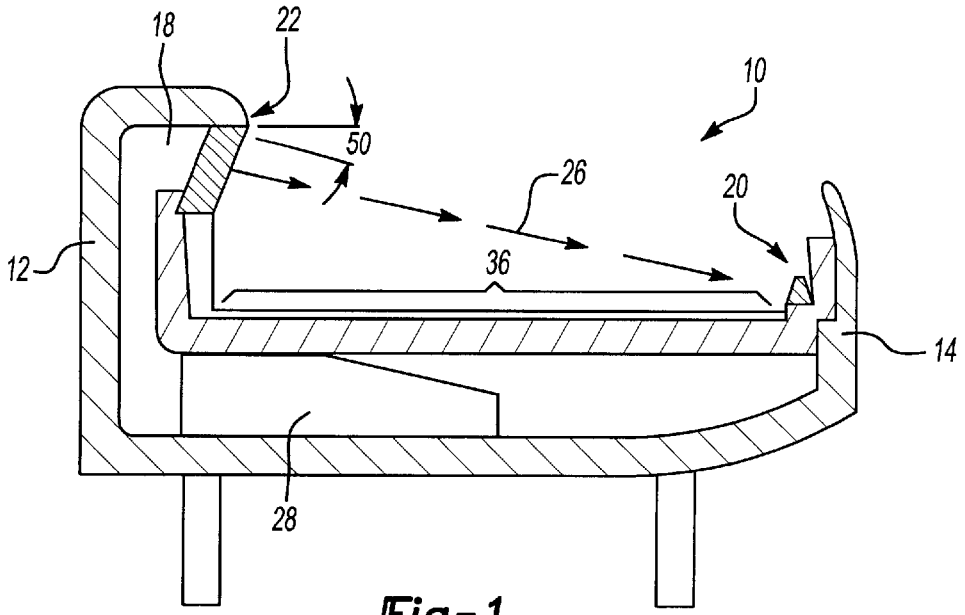
FIG. 1 is cross-sectional view of a display case.
Figure 2:
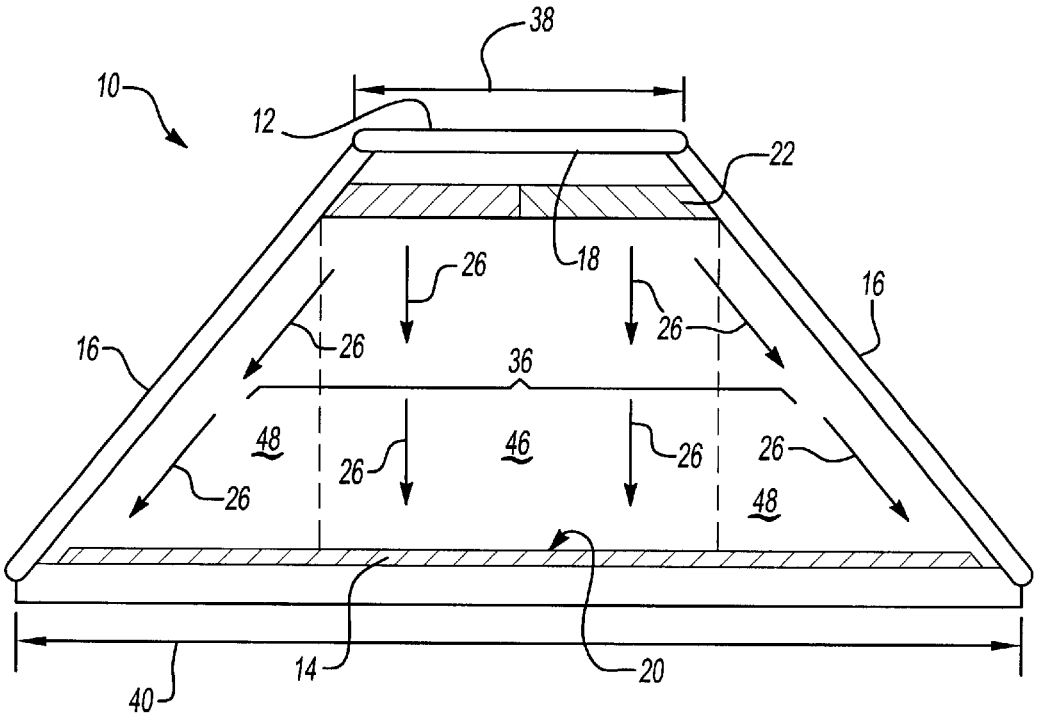
FIG. 2 is a top view of the display case.

Referring to the Figures, wherein like numerals indicate like or corresponding parts throughout the several views, the subject invention is a refrigerated display case for displaying items at temperatures below the surrounding ambient temperature and is generally shown at 10 in FIG. 1. Referring to FIGS. 1 and 2, the display case 10 includes a back 12 of a first length 38 and a front 14 having a second length 40. Sides 16 connect the back 12 to the front 14 to form a product display area 36 therein. The second length 40 of the front 14 is substantially greater than the first length 38 of the back 12 such that the display case 10 is substantially wedge shaped. The wedge shape of the display case and as used in this application refers to any configuration where the warm air return 20 is substantially longer than the cold air discharge 18. The product display area 36 of the wedge shaped display case 10 includes a center section 46 and outside sections 48. The wedge shape of the display case 10 provides for an outside corner section that may be combined with other display cases to form a continuous display of products around corners. A cold air discharge 18 positioned along the back 12 of the display case 10 discharges air cooled by a refrigeration system 28. Preferably the refrigeration system 28 is positioned within the display case 10. A warm air return 20 is positioned along the front 14 of the display case 10 to return air to the refrigeration system 28 for cooling and discharge back into the product display area 36.

Cold air from the discharge 18 flows through the product display area 36 and into the warm air return 20. A diffuser 22 is positioned at in front of the cold air discharge 18 to direct the flow of cold air downward at a vertical angle 50 toward the warm air return.

Figure 3:
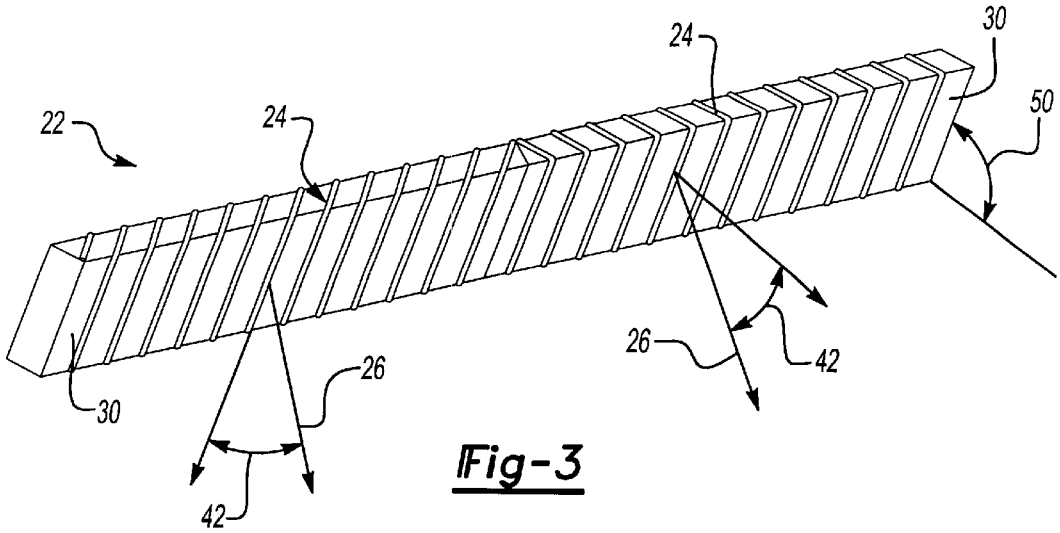
FIG. 3 is a perspective view of a diffuser.

Referring also to FIG. 3, the diffuser 22 is made up of multiple panels 30, and each panel 30 includes a plurality of flow directing channels, known as straws 24 for directing the flow air 26 over the entire display area 36. The straws 24 are disposed at an angle 42 relative to the flow of air 26 such that cold air flows over the entire area of the display area 36. The straws 24 direct the flow of air toward the sides 16 of the display case 10 so that all areas in the display area 36 are cooled generally uniformly. The straws 24 can be of any angle to provide airflow to the outside sections 48 of the display area 36. Preferably the angle is between 10 and 30 degrees relative to the direction of airflow 26 from the cold air discharge 18. The angle 42 of the straws 24 depends on the difference between the first and second lengths 38,40 of the back 12 and the front 14. The angle 42 of the straw 24 is greatest for the largest differences between the first and second lengths 38,40 so that airflow from the cold air discharge 18 may adequately and uniformly reach even the furthest points of the outside sections 48 of the display area 36.

As shown in FIG. 3, the diffuser 22 includes two panels 30 each containing a plurality of straws 24 that are disposed at angle 42. As appreciated, the angle 42 of each of the straws 24 disposed in one panel 30 are opposite those disposed in the other panel 30 such that airflow is directed toward opposite ends of the display area 36.

Figure 4:
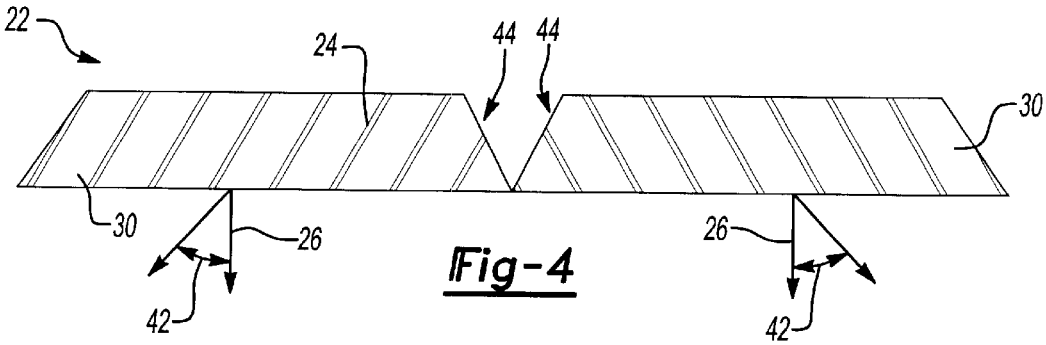
FIG. 4 is a top sectional view of a second embodiment of the diffuser.

Because the straws 24 are positioned to direct airflow toward the sides of the display case 10, airflow through the center section 46 of the display area 36 may be decreased thereby providing non-uniform cooling. Referring to FIG. 4 another embodiment improves air flow through the center of the display area by removing an outer end section 44 from each panel 30 such that air flowing through the panels 30 near the end sections combine to cause additional air flow through the center section 46 of the display area 36 such that the product display area 36 is uniformly cooled.

Figure 5:
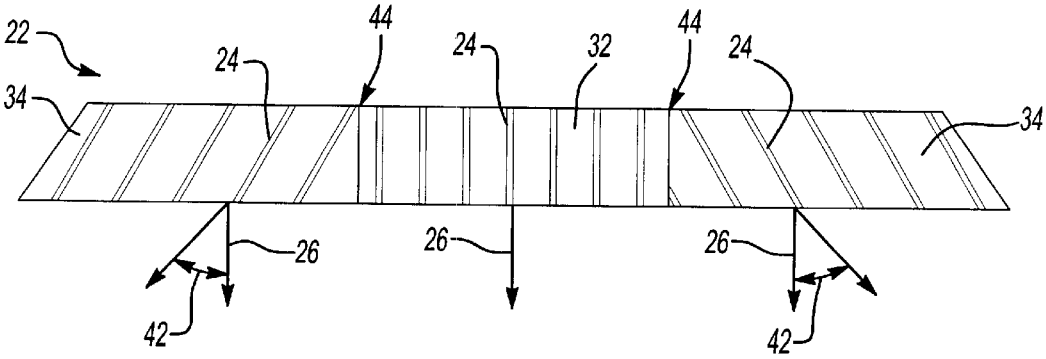
FIG. 5 is a top sectional view of a third embodiment of the diffuser.
Figure 6:
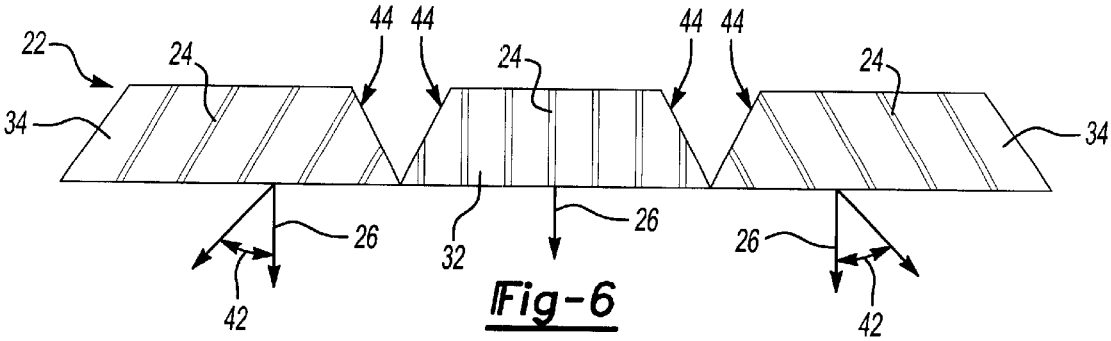
FIG. 6 is a top sectional view of a fourth embodiment of the diffuser.

Referring to FIG. 5, another embodiment for ensuring the uniform distribution of airflow through the center of the product display area 46 is shown including a center panel 32 positioned between side panels 34. The center panel 32 includes straws 24 disposed parallel to the flow of air 26. The side panels 34 include straws 24 disposed at an angle 42 to the flow of air 26 to direct airflow toward respective sides of the display case 10. The center panel and the side panels of the embodiment shown in FIG. 5 include end sections 44 such that airflow at adjacent ends between the center panel 32 and the side panels 34 does not combine. FIG. 6 illustrates a combination of the embodiments shown in FIGS. 4 and 5 where the center panel 32 and the side panels 34 have an end section 44 removed to promote the combination of airflow were the center panel 32 meets the side panels 34.

The angle such as shown at 42 in the figures are non-parallel to the nominally forward direction 26. More preferably, the angles are directed outwardly relative to the nominally forward direction 26. As can be appreciated from FIG. 2, if air flow were to continue the nominally forward direction 26 the edges of the case would not be adequately cooled. While a particular type of flow directing structure, commonly known as straws, is disclosed, other types of flow directing structure would come within the scope of this invention.

The foregoing description is exemplary and not just a material specification. The invention has been described in an illustrative manner, and should be understood that the terminology used is intended to be in the nature of words of description rather than of limitation. Many modifications and variations of the present invention are possible in light of the above teachings. The preferred embodiments of this invention have been disclosed, however, one of ordinary skill in the art would recognize that certain modifications are within the scope of this invention. It is understood that within the scope of the appended claims, the invention may be practiced otherwise than as specifically described. For that reason the following claims should be studied to determine the true scope and content of this invention.

What is claimed is:

1. A display case comprising;

a back, a front and two sides connecting said back and front, said back being smaller than said front, an air discharge disposed at said back;

an air return disposed at said front;

a diffuser disposed at said air discharge and including a plurality of flow directing structures positioned at a non-parallel angel relative to the flow of air from the air discharge to direct air flow toward said sides.

2. The assembly of claim 1, wherein said air discharge is substantially the same length as said back, and said air return is substantially the same length as said front.

3. The display case of claim 2, wherein said diffuser includes separate panels each containing said flow directing structures to direct air toward said sides of said display case.

4. The display case of claim 3, wherein said flow directing structures in said panels are directed toward respective sides at a predetermined angle.

5. The display case of claim 4, wherein said predetermined angle is between 10 and 30 degrees from the direction of airflow.

6. The display case of claim 3, wherein said panels have at least one adjacent end and flow directing structures at said adjacent end are parallel to the flow of air such that flow is directed toward said front of said display case.

7. The display case of claim 6, wherein said diffuser includes a center panel and two side panels, said center panel including flow directing structures disposed parallel to the flow of air, said side panels including flow directing structures disposed at angle to the flow of air to direct flow toward respective sides of the display case.

8. The display case of claim 1, wherein said display case is refrigerated to keep displayed items at a temperature below the ambient surrounding temperature.

9. A refrigerated display case for displaying items at a temperature below the surrounding ambient temperature, said display case comprising;

a back having a first length;

a front having a second length substantially greater than said first length such that said display case is substantially wedge shaped;

two sides connecting said back and front to form a product display area therein;

a cold air discharge disposed at said back;

a warm air return disposed at said front; and a diffuser disposed at said cold air discharge and including a plurality of flow directing structures for directing the flow air toward said sides of said display area.

10. The display case of claim 9, wherein said flow directing structures are disposed at a non-parallel angle to said flow of air such that air from said cold air discharge cools said display area.

11. The display case of claim 10, wherein said diffuser includes panels and said flow directing structures are disposed within said panels.

12. The display case of claim 11, wherein each of said panels includes at least one flow directing structures disposed parallel to the flow of air to direct airflow through a center section of the display area.

13. The display case of claim 10, wherein there is a center panel and two side panels, said center panel including flow directing structures disposed parallel to the flow of air, said side panels including flow directing structures disposed to direct the flow of air at a predetermined angle toward said sides of said display case.

14. The assembly of claim 9, wherein said diffuser is disposed at a vertical angle relative to the flow of air such that air is directed toward said warm air return.

* * * * *

UNITED STATES PATENT AND TRADEMARK OFFICE

CERTIFICATE OF CORRECTION

PATENT NO. : 6,381,976 B1
DATED : May 7, 2002
INVENTOR(S) : Michael J. Kempiak and Wayne I. Flaska It is certified that error appears in the above-identified patent and that said Letters Patent is hereby corrected as shown below:

Column 4,
Line 4, replace “angel” with -- angle --.

Signed and Sealed this

Twelfth Day of November, 2002

*Attest:*

*Attesting Officer*

JAMES E. ROGAN
*Director of the United States Patent and Trademark Office*